US005458160A

United States Patent [19]

Geiger et al.

[11] Patent Number: 5,458,160

[45] Date of Patent: Oct. 17, 1995

[54] CONTROLLING PILE WARP THREAD TENSION IN A TERRY LOOM

[75] Inventors: Erwin Geiger; Hubertus Ludwig, both of Lindau, Germany

[73] Assignee: Lindauer Dornier Gesellschaft mbH, Lindau, Germany

[21] Appl. No.: 221,406

[22] Filed: Mar. 31, 1994

[30] Foreign Application Priority Data

Apr. 2, 1993 [DE] Germany ..... 43 10 840.7

[51] Int. Cl.[6] ..... D03D 27/08

[52] U.S. Cl. ..... 139/25; 139/102

[58] Field of Search ..... 139/25, 102

[56] References Cited

U.S. PATENT DOCUMENTS

| | | | |
|---|---|---|---|
| 4,293,006 | 10/1981 | Peter | 139/25 X |
| 4,569,373 | 2/1986 | Vogel | 139/25 |
| 4,949,759 | 8/1990 | Takegawa et al. | 139/25 |
| 4,974,639 | 12/1990 | Maitan et al. | 139/25 X |
| 5,099,890 | 3/1992 | Duetsch et al. | 139/102 |

FOREIGN PATENT DOCUMENTS 2318326 10/1974 Germany .

2817185 10/1979 Germany .

*Primary Examiner*—Andrew M. Falik

*Attorney, Agent, or Firm*—W. G. Fasse; W. F. Fasse

[57] ABSTRACT

In a method for controlling the pile warp thread tension in weaving terry cloth webs, a thread tension is applied to the pile warp by the spanner beam during partial beat-up operations. The tension is removed or reduced in a controlled manner during each full beat-up motion of the weaving reed and is then reapplied in a controlled manner after the binding-in or interlacing of each pile loop row. An apparatus for carrying out the method includes a spanner beam (7) carried on the free ends of swing arms (6) of which the other ends are rotationally mounted on a supporting shaft (8). A pushing force element is operatively connected to at least one of the swing arms (6) to push the swing arm and therewith the spanner beam in one swinging direction and thereby apply a bias thread tension to the pile warp (4). A controllable pulling force element controlledly applies a pulling force to the swing arm (6) at appropriate times during a weaving operating cycle to counteract the pushing bias force and swing the spanner beam (7) in the other direction to relieve thread tension from the pile warp.

15 Claims, 2 Drawing Sheets

CONTROLLING PILE WARP THREAD TENSION IN A TERRY LOOM

FIELD OF THE INVENTION

The invention relates to a method and an apparatus for manufacturing terry cloth fabrics on a loom equipped with a terrying apparatus and with an arrangement for weaving with two separate warp thread systems. A nap or pile warp gang is held under relatively low tension to form the pile warp loops of the fabric, while a base warp gang is held under relatively higher tension to form the base web of the fabric. The method and apparatus of the invention control the pile warp thread tension for producing a terry cloth having a controllable and uniform terry pile.

BACKGROUND INFORMATION

By means of the terrying apparatus in such looms for manufacturing a terry cloth web, several weft threads are partially beat-up one after another by the weaving reed to a predetermined point located a certain spacing away from the beat-up edge or interlacing point. Then, the several weft threads are together fully beat-up to the beat-up edge or interlacing point. During this procedure, the base warp threads are tightly tensioned and the weft threads glide along the tightly held base warp threads. The nap or pile warp threads, on the other hand, have a relatively lower tension and are held and pulled along by the weft threads as the weft threads are beat-up, so that rows of pile loops are formed by the nap or pile warp.

In order to produce a so-called three-shot terry cloth fabric, the process described above is carried out with two partial beat-up cycles respectively followed by one full beat-up cycle. Correspondingly, to produce a so-called four-shot terry cloth fabric, a full beat-up cycle respectively follows each three partial beat-up cycles. In such a process, the final nap or pile loop height is predominantly determined by the spacing of the several weft threads or the shot group from the beat-up edge or interlacing point of the fabric web at the time of the partial beat-up cycles.

In order to achieve a uniform visual appearance and therewith produce a high quality, high value terry cloth product, for example a terry cloth towel, it is necessary to achieve pile loop rows that are continuously uniform across the entire web length and from border to border of the web. The determinative factor for achieving such a desirable finished result is that all of the individual pile warp threads of the pile warp thread gang should have a practically uniform thread tension at each full beat-up cycle, whereby the uniform thread tension can also be a zero or null tension. It is important, as is generally known, that the pile loops formed by the respective last full beat-up are not pulled out of the woven web either during or after the full beat-up cycle due to the tension applied to the pile warp.

In known looms, the tension of the pile warp threads is momentarily reduced at the beginning of each full beat-up motion by venting the brake for the pile warp beam at the appropriate point in time. This solution is only slightly effective and is rarely used in practice today because of the substantial moment of inertia caused by the mass of the pile warp beam.

Looms are also known which have a special pile warp delivery arrangement. In such looms, the pile warp beam is momentarily accelerated during the full beat-up of the reed. This apparatus is combined with a take-off or let-off roller embodied in the form of a sand beam or sand roller or with a roller pair, by means of which, at the appropriate instant, the pile warp is let off or stripped from the warp beam at a faster rate and delivered to the loom shed in a practically tension-free state. In such a prior art solution, a substantial difficulty exists in trying to optimally match the velocity and amplitude of the additional feed advance of the pile warp to the specific requirements of the weaving process at hand, for example, to the intended length of the pile loops. It is necessary to change the speed and amplitude of the additional feed advance of the pile warp, for example, when switching over to a different weaving pattern, due to the differing requirements of different qualities of yarn or thread. This is necessary in order to reliably provide the prescribed length of pile warp thread in a practically tension-free condition during every full beat-up motion.

The German Patent Laying-Open Publication 2,318,326 discloses a method and a thread supply arrangement for pile warp threads in a loom for weaving shear nap terry cloth articles, wherein a measured pile warp thread supply is built up between every two respective successive full beat-up cycles. During the stock-piling or reserve process, the pile warp is held between the reservoir and the loom shed, in order to prevent the shear nap pile from being pulled out backwards. Furthermore, the lengths of thread necessary for forming the shear nap pile are freely released in a practically tension-free manner during the following full beat-up motion.

For carrying out the method, the reference suggests that a pile warp thread supply or reserve is built up during the time interval between two respective succeeding full beat-up cycles in an intermediate thread reservoir or thread store arranged downstream of the pile warp let-off arrangement. The intermediate reserving or storing of thread is carried out by means of a deflecting beam that can be driven through a rod linkage by a cam drive that is coupled to the reed drive of the loom. Furthermore, a cam controlled clamping arrangement for the pile warp is operatively connected to the intermediate reservoir or store. During each full or complete beat-up, the clamping arrangement and the intermediate reservoir are opened by means of the described cam drive, whereby the stored length of the pile warp is freely available in a tension-free state for forming the row of pile loops. Practicing such a method and especially using the apparatus described for the purpose is relatively costly and complicated and requires great effort, especially in view of the complex control arrangement required for providing the necessary thread storage for an entire pile warp thread gang.

German Patent Publication 2,817,185 discloses a pile warp thread let-off arrangement for a terry cloth loom, wherein the drive for the pile warp beam is controlled by a pendular swinging feeler or sensor element for the pile warp threads. The swinging sensor element is arranged parallel to and between two rotating guide idlers that are arranged at fixed locations following one another after the pile warp beam in the direction of the thread let-off. In its end positions, the sensor element actuates control switches for the pile warp beam drive. In one end position, the swinging sensor element lies essentially in a plane defined by the two guide idlers arranged at fixed locations. However, when the sensor element moves out of this end position, it deflects the pile warp threads out of their straight path, in order to form and provide the necessary pile warp thread reserve for the complete beat-up cycle. Even though only minimal pile warp tensioning forces arise due to the specific embodiment of the sensor element, and due to its low mass, it has been found that improvements in pile uniformity can still be achieved.

In comparison to various prior art approaches, the tension force applied to the pile warp must be at least large enough to completely prevent the formation of slack pile warp threads in the pile warp during the partial beat-up of the weaving reed. If this is not the case, then slack in the threads could lead to twisting and tangling among the individual pile warp threads. Thereupon, it would no longer be possible to assuredly prevent breaking of the pile warp threads. Furthermore, it must be noted that, in looms operating at high speeds, an uncontrolled swinging or oscillating of the pendular sensor element can have disadvantageous or negative influences on the formation of the pile loop rows, namely, because the pile warp threads could be partially pulled backwards after each complete beat-up motion.

OBJECTS OF THE INVENTION

In view of the above it is the aim of the invention to achieve the following objects singly or in combination:

- to provide a method of controlling the pile warp thread tension in manufacturing terry cloth webs on looms, wherein the formation of a uniform pile height and therewith an overall uniform visual appearance of the pile loop rows in a terry cloth web is achieved independently of the machine speed in rotations per full beat-up of the weaving reed;
- to provide an apparatus for carrying out the above method;
- to provide such a method and apparatus for controlling the pile warp thread tension throughout all phases of operation of a loom, so that uniform pile loops are formed during a full beat-up, and that the loops are not pulled out again during following phases of the weaving process;
- to provide such a method and apparatus wherein a pile warp thread tension is applied during partial beat-up cycles, relieved during each full beat-up cycle, and reapplied after each binding-in operation;
- to avoid twisting or tangling of individual pile warp threads or several pile warp threads with each other in such a method and apparatus; and
- to provide such an apparatus that is relatively simple in construction and operation.

SUMMARY OF THE INVENTION

The above objects have been achieved according to the method of the invention as applied in looms for manufacturing terry cloth webs for controlling the tension of the pile warp, which is to be taken off from the pile warp beam by a warp let-off arrangement. The pile warp is let off over at least one guide idler roller and a spanner beam, whereupon the tension of the pile warp is affected or controlled during each full beat-up following the partial beat-up cycles of a weaving reed connected to a weaving reed shaft for forming a pile loop row. Particularly, according to the invention, the tension applied to the pile warp by the spanner beam is controlledly reduced or removed during each full beat-up of the weaving reed and then again controlledly reapplied after the binding-in or interlacing of each pile loop row. Preferably, when the pile warp thread tension is reduced or removed, it is released to substantially null tension.

The apparatus provided according to the invention includes a control mechanism operatively connected to the spanner beam. The control mechanism sets the spanner beam into a controlled oscillating motion. In this manner, the pile warp thread tension is removed in a controlled manner during each full beat-up of the weaving reed and is then reapplied after the binding-in or interlacing of each pile loop row, so as to prevent the pulling back or pulling out of the pile warp out of the formed and interlaced pile loop row.

In this manner, it is assured that tension loads are removed from the pile warp to the extent necessary at each full beat-up of the weaving reed, so that a predetermined pile height of each pile loop row in the terry cloth web can be achieved and maintained as a constant across the entire weaving width and weaving length so that a terry cloth web of high quality can be produced.

BRIEF DESCRIPTION OF THE DRAWINGS

In order that the invention may be clearly understood, it will now be described, by way of example, with reference to the accompanying drawings, wherein.

Figure 1:
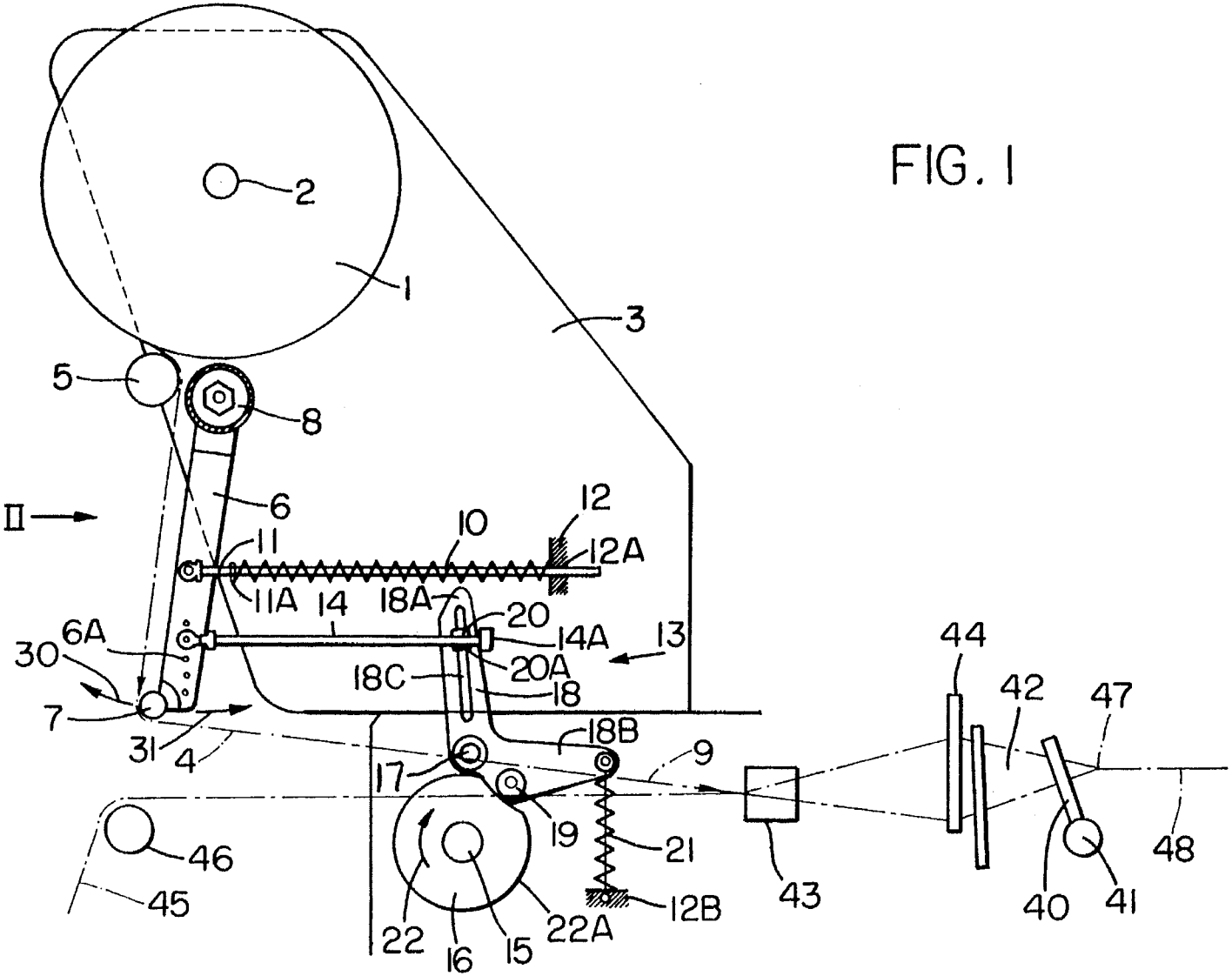
FIG. 1 is a schematic side view of an apparatus for controlling the pile warp thread tension according to the invention seen, in a view direction indicated by the arrow I in FIG. 2.

DETAILED DESCRIPTION OF PREFERRED EXAMPLE EMBODIMENTS AND OF THE BEST MODE OF THE INVENTION

In a preferred embodiment of the invention, the pile warp 4 can be guided from a pile warp beam 1 over a single guide idler roller 5 or a pair of guide idler rollers, which is arranged close to the pile warp beam 1. The one or two idler rollers 5 are rotatably supported in the side walls of the loom. A supporting shaft 8 is provided and arranged parallel to the idler roller 5, over which the pile warp is guided. Swing arms 6 are swingably attached to the support shaft 8 to extend substantially vertically relative to the loom. The spanner beam 7 is carried at the free ends of the swing arms. The pile warp 4, which is guided over the idler roller or idler rollers is then redirected around the spanner beam 7 in a direction toward the formation of the loom shed 11.

A compression spring loaded strut or push rod 11 is attached to at least one of the swing arms 6 to apply tension to the pile warp guided over the spanner beam. A pull rod 14, arranged parallel to the strut or push rod and in a vertical plane therewith is also attached to the swing arm. The opposite or free end of the pull rod is operatively connected to a lever arrangement, for example, to one lever arm 18A of a two armed lever. The other lever arm 18B is connected to a tension spring 21 that rotationally biases the double-arm lever about a journal axle 17 arranged substantially at the junction between the two lever arms. A follower or feeler roller 19 is arranged on the double-arm lever 18 at a distance away from the journal axle 17. The follower or feeler roller 19 is held in surface-to-surface contact with an eccentric member 16 arranged on a drive shaft, i.e. the terrying shaft 15. The eccentric member 16 can be embodied as a simple or single eccentric or as a complementary eccentric. The tension applied by the tension spring 21 causes corresponding pivoting movement of the double-arm lever 18 to keep the follower roller 19 in continuous surface contact with the eccentric 16.

The control mechanism elements are arranged in such a manner that the tension is removed from the pile warp in synchronism with and at each full beat-up of the weaving reed 40, which forms a pile loop row. The pile warp tension is removed because the swing arm 6 and therewith the spanner beam is pulled in a direction toward the full beat-up of the weaving reed 40. This is achieved in that the tension spring 21 attached to the second arm 18B of the lever arrangement applies a rotational force that tends to rotate the lever 10 arrangement and pull the swing arm. The extent of rotation of the lever arrangement is controlled by the follower roller 19 following in contact with the surface of the eccentric member 16. Thus, a portion of the eccentric surface 22A pushes the follower roller 19 to resist the rotational and pulling force of the tension spring 21 and a portion of the eccentric surface is indented to allow the lever arrangement to be rotated by the tension spring 21. Thus, the pull rod 14, which is connected at one end to the swing arm 6 and which is pulled at the other end by, the lever arrangement acting on a stroke limiting stop 14A, pulls the swing arm 6 against the biasing force of the compression spring 10 arranged on the push arm strut 11 so as to remove or relieve the thread tension in the pile warp.

A particular embodiment will now be described with reference to the drawings. As shown by the schematic side view of FIG. 1, a pile warp beam 1 is rotatably supported on an axle 2 held in the machine side walls 3. For the sake of clarity in the figure, the side wall at the front of the view has been omitted. The pile warp 4 is let off the pile warp beam 1 by a warp supply or let-off arrangement that is not shown, but can be of conventional construction. After the pile warp 4 is let off the pile warp beam 1, it passes over a guide shaft or idler roller 5, which is arranged close to the pile warp beam 1 and rotatably supported at its ends in the machine side walls 3. From there, the pile warp 4 is directed substantially downward to and around the spanner beam 7, which is supported by at least two swing arms 6. Each swing arm 6 is attached at its lower end to the spanner beam 7 while its upper end is rotatably supported by a supporting shaft 8, which is rotatably held by the machine walls 3. After passing around and under the spanner beam 7, the pile warp 4 continues toward the right as shown in the figure through a known warp stop motion device 43, toward the area of the shed formation 42, as indicated by the arrow 9.

For the sake of clarity and simplicity, the base or ground warp 45 and its associated supply and guide elements are shown rather generally in the drawings. As generally known in the art, and using conventional elements, the yarns of the ground warp 45 are let off from a ground warp beam, pass over a tension regulating roller 46, and then pass through the warp stop motion device 43 together with the pile warp 4. Downstream from the stop motion device 43, a pair of heddles 44 form the shed 42, where the weaving reed 40 is driven by a weaving reed drive 41 to beat up the weft threads at the beat up edge 47. The finished terry cloth web 48 exits to the right in FIG. 1.

It is an essential point of the invention that a biasing force element is connected to at least one of the swing arms 6 to apply a biasing force to the spanner beam 7 through the swing arm 6, and a force relieving element is connected to at least one of the swing arms 6, to intermittently overcome the biasing force. The biasing force element can be selected from among mechanical, pneumatic, hydraulic, hydromechanical, pneumomechanical, electrical and electromechanical force applying elements. In a particular embodiment, on the one hand, a compressively biased element 11 acts on the spanner beam 7 to apply a constant tension to the pile warp 4, while on the other hand, a tension biased element 14 acts on the spanner beam 7 at appropriate times during an operating cycle so as to counteract the force applied by the compressively biased element 11 and thereby remove the tension from the pile warp.

In the embodiment of the invention shown in FIG. 1, the above described arrangement includes a strut or push rod 11, of which one end is articulately connected to the swing arm 6 and the other end is slidingly guided through a hole 12A provided in a fixed machine component 12. A compression spring 10 is arranged around the push rod 11 to apply a compressive bias force between the machine component 12 and a force collar 11A provided on the push rod 11. In this manner, the compression spring 10 tends to apply a constant bias force onto the swing arm 6 and spanner beam 7, pushing it in a direction shown by the arrow 30.

On the other hand, a pull rod 14 is provided, which intermittently applies a force to the swing arm 6 tending to swing the spanner beam 7 in the direction indicated by arrow 31. Thus, the pulling force applied by pull rod 14 overpowers the pushing force applied by push rod 11 in a controlled and intermittent manner at appropriate times during the operating cycle, so that the thread tension on the pile warp 4 is relieved at those times. More specifically, the thread tension in the pile warp 4 is removed or relieved at the time of performing the full beat-up during each operating cycle. This is achieved in that one end of the pull rod 14 is articulately connected and journalled at one of several adjustment holes 6A provided in the swing arm 6. The other end of the pull rod 14 is connected to a control mechanism 13 that is driven and controlled by the loom drive so that it applies a pulling force to the pull rod 14 at the appropriate times in the operating cycle.

For example, in order to produce a so-called three-shot binding, during each working cycle the weaving reed 40 performs two partial beat-up motions and then a full beat-up in order to form a row of pile loops at the beat-up point. The control mechanism 13 applies a pulling force to the pull rod 14 during the full beat-up of the weaving reed 40 in order to relieve the thread tension in the pile warp 4 during that time. After the full beat-up and binding-in of the weft threads at the beat up point 47, the control mechanism 13 controlledly releases the pulling force from the pull rod 14 so that the push-rod 11 under the effect of the compression spring 10 again applies the same thread tension to the pile warp 4 as was applied before the tension was removed during the full beat-up.

In the embodiment of FIG. 1, the control mechanism 13 includes an eccentric member 16, which may be a single eccentric or a complementary eccentric, arranged on a drive shaft or terrying shaft 15. The terrying shaft 15 is driven in synchronism with the general loom drive which drives the weaving reed drive 41. A control lever 18 rotatably carries a follower roller 19, which follows or rolls along in contact with the eccentric surface 22A of eccentric member 16. The control lever 18 is rotatably mounted on an axle 17, which is spaced a distance away from the rotation axis of follower roller 19. Thus, the control lever 18 is caused to rotate about the axle 17 in response to the follower roller 19 following the eccentric surface 22A of eccentric member 16.

The control lever 18 is preferably a two-armed lever having lever arms 18A and 18B. A tension spring 21 is connected to the lever arm 18B and to a fixed machine component 12B to apply a rotational bias force to the control lever 18 in a clockwise direction as shown in FIG. 1. This bias force tends to hold the roller 19 in contact with the eccentric 16 and to pull the other lever arm 18A in a direction tending to apply a pulling force to the pull rod 14.

The end of the pull rod 14 at the control lever 18 slidingly passes through a hole 20A in a guide bushing 20, which is adjustably secured in an elongated hole or slot 18C provided in the lever arm 18A. A stroke limiting stop 14A is provided on the free end of pull rod 14. When the control lever 18 applies a pulling force to pull rod 14, the edge of lever arm 18A bears against the stroke limiting stop 14A to apply the pulling force to the pull rod 14. Alternatively, the guide bushing 20 may bear against the stroke limiting stop 14A.

As the eccentric member 16 rotates in the direction of arrow 22, the control lever 18 will rotationally oscillate back and forth, alternatingly applying a pulling force to pull rod 14 and then releasing the pulling force. It should be noted that the various parameters of the thread tension to be applied to the pile warp 4 throughout the course of a weaving cycle can be adjusted as necessary. For example, the two ends of the pull rod 14 can be adjusted respectively at adjustment holes 6A and within the elongated hole or slot 18C to adjust the total amount of swinging oscillation in the directions 30 and 31 imparted to the spanner beam 7 and therewith the total tension and slack imparted on the pile warp 4. The strengths of compression spring 10 and tension spring 21 can be selected or adjusted as desired in order to adjust the tension imparted to the pile warp 4. This can be achieved, for example, by moving the collar 11A which may, for example, be an adjustable collar having an internal threading which may be adjustably screwed along a threading provided on push rod 11. Furthermore, if a complementary eccentric member 16 is provided rather than the single eccentric member 16 as shown, then the specific structure and embodiment of the control lever 18 would, of course, be different. In fact, the control mechanism 13 need not be a control lever, and particularly need not be a two-armed control lever 18.

Figure 2:
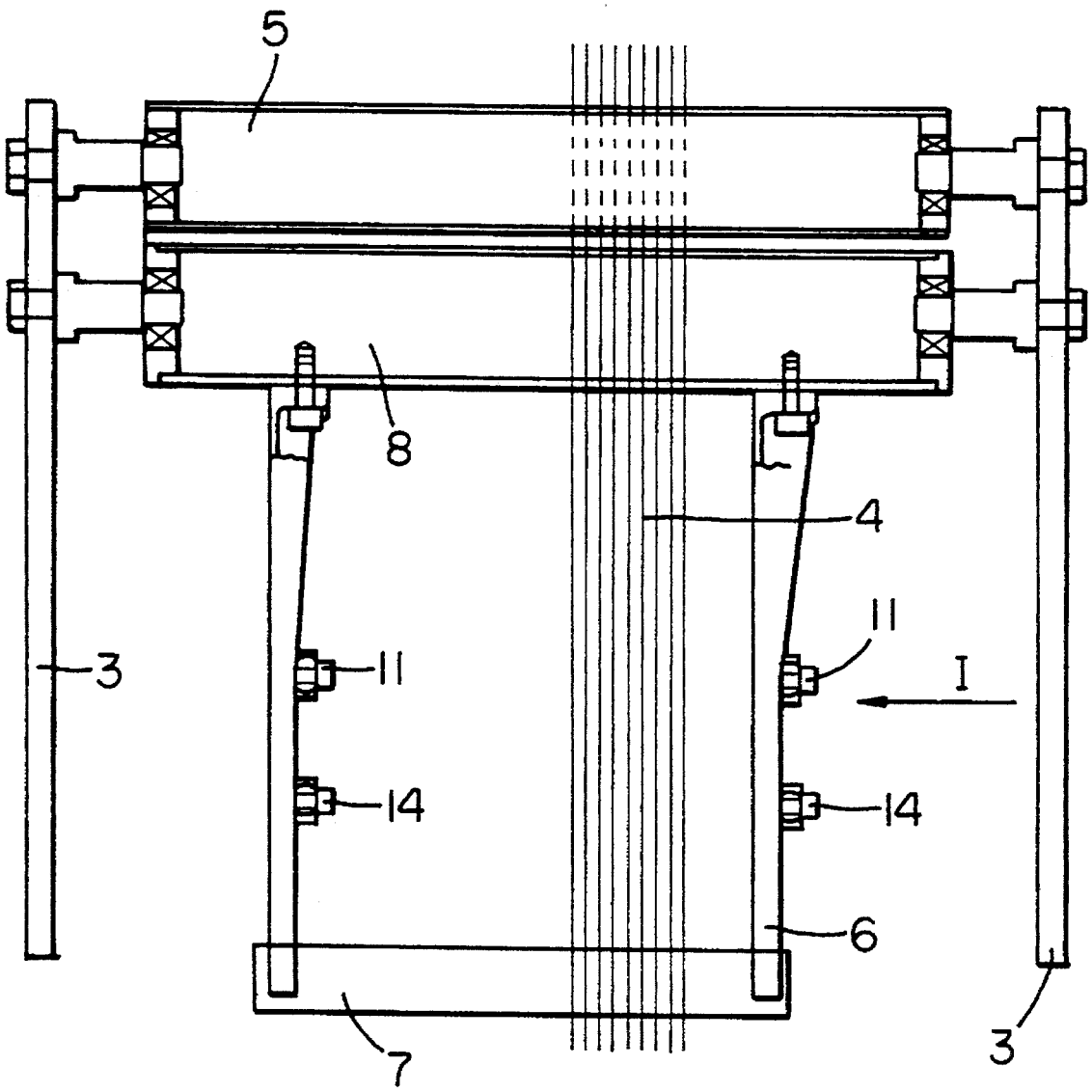
FIG. 2 is a partial schematic end view of the arrangement shown in FIG. 1, taken substantially in the direction of view II of FIG. 1.

FIG. 2 is a partial schematic front view of the loom arrangement shown in FIG. 1 taken in the viewing direction II of FIG. 1. For the sake of clarity, several components shown in FIG. 1 are omitted in FIG. 2. For example, the pile warp beam 1 and the control mechanism 13 are omitted. FIG. 2 generally shows the pile warp 4 passing behind the idler roller 5 and then passing in front of the supporting shaft 8. For the sake of clarity, the images of roller 5 and shaft 8 do not overlap, even though the elements are arranged partly one behind the other as shown in FIG. 1. The supporting shaft 8 carries the two swing arms 6 of which the free ends are attached at respective ends of the spreader beam 7. As shown, a respective push rod 11 and pull rod 14 may be arranged at each swing arm 6, but may also only be provided on one of the swing arms 6.

Thus, the apparatus and method according to the invention avoid uncontrolled oscillations or swinging of the spanner beam, which applies tension to the pile warp threads, whereby a constantly controlled tension is applied to the pile warp throughout the weaving process. The applied thread tension can be removed or released and then reapplied at appropriately controlled instants during the weaving operation. In this manner the uniform feed of the pile warp threads is achieved and therewith an overall uniform height of the pile of the terry cloth web is achieved.

Although the invention has been described with reference to specific example embodiments, it will be appreciated that it is intended to cover all modifications and equivalents within the scope of the appended claims.

What is claimed is:

1. A method for controlling the thread tension of a pile warp while weaving a terry cloth web on a loom having a warp let-off controlled pile warp beam, at least one guide roller, a spanner beam and a weaving reed, the method comprising the following steps:

(a) letting off the pile warp from the pile warp beam and guiding the pile warp over the guide roller and over the spanner beam;

(b) applying to the pile warp a controlled pile warp thread tension with the spanner beam;

(c) performing at least one partial beat-up with the weaving reed;

(d) performing a full beat-up with the weaving reed following said partial beat-up, for forming a row of pile loops;

(e) reducing said pile warp thread tension in a controlled manner during said full beat-up sufficiently for forming the row of pile loops;

(f) binding-in the row of pile loops; and (g) reapplying said pile warp thread tension in a controlled manner after said binding-in of the row of pile loops.

2. The method of claim 1, wherein said step of reducing said pile warp thread tension comprises releasing said pile warp thread tension to substantially null tension.

3. The method of claim 1, further comprising maintaining said controlled pile warp thread tension as a substantially uniform tension while said pile warp thread tension is being applied, and preventing uncontrolled oscillation of the spanner beam.

4. The method of claim 1, wherein said step of applying said controlled pile warp thread tension comprises continuously applying a biasing force in a first direction to a swing arm carrying the spanner beam suspended as a pendulum on the swing arm, and said step of reducing said pile warp thread tension comprises applying a controlled intermittent force in a second direction to the swing arm, wherein said second direction is substantially opposite said first direction and said controlled intermittent force overcomes said biasing force.

5. An apparatus for controlling the thread tension of a pile warp for weaving a terry cloth web on a loom having a pile warp beam, a guide roller, a spanner beam applying a thread tension to the pile warp, at least two swing arms swingably supported on at least one common axis shaft and carrying the spanner beam to be swingable, a weaving reed and a weaving reed drive, said apparatus comprising a biasing force element adapted to be operatively connected to at least one of the swing arms and to be supported against a fixed component of the loom to apply a biasing force to the spanner beam through the swing arm, and a controlled intermittently operative force relieving element adapted to be operatively connected to at least one of the swing arms to intermittently overcome said biasing force, wherein said force relieving element comprises a terrying shaft driveable in dependence on the weaving reed drive, an eccentric member having an eccentric surface and connected to said terrying shaft, a rotatable lever, an eccentric follower mounted on said lever and contacting said eccentric surface, and a pull rod operatively connected to the swing arm and to said lever.

6. The apparatus of claim 5, wherein said biasing force element is a compressive force element and said force relieving element is a tension force element.

7. The apparatus of claim 5, wherein said eccentric member is a single, simple eccentric.

8. The apparatus of claim 5, wherein said force relieving element further comprises a guide bushing mounted on said lever and having a hole therethrough, and a stroke limiting stop arranged at a first end of said pull rod, wherein a second end of said pull rod is articulately connected to the swing arm and the pull rod slidingly passes through said hole in said guide bushing near said first end.

9. The apparatus of claim 8, wherein said force relieving element further comprises a tension spring connected to said lever to rotationally bias said lever to hold said follower in contact with said eccentric surface.

10. The apparatus of claim 8, wherein said biasing force element comprises a push rod articulately connected to the swing arm, and a compression spring arranged to apply a pushing bias force to said push rod relative to the fixed component of the loom.

11. The apparatus of claim 5, wherein said lever and the swing arm each have an adjustable connection hole for adjustably connecting said pull rod at a selected position along said lever and the swing arm.

12. The apparatus of claim 1, wherein said adjustable connection hole comprises an elongated slot hole.

13. The apparatus of claim 11, wherein said adjustable connection hole comprises a plurality of individual selectable holes.

14. An apparatus for controlling the thread tension of a pile warp for weaving a terry cloth web on a loom having a pile warp beam, a guide roller, a spanner beam applying a thread tension to the pile warp, at least two swing arms swingably supported on at least one common axis shaft and carrying the spanner beam to be swingable, a weaving reed and a weaving reed drive, said apparatus comprising a biasing force element adapted to be operatively connected to at least one of the swing arms and to be supported against a fixed component of the loom to apply a biasing force to the spanner beam through the swing arm, and a controlled intermittently operative force relieving element adapted to be operatively connected to at least one of the swing arms to intermittently overcome said biasing force, wherein said biasing force element comprises a push rod articulately connected to the swing arm, and a compression spring arranged to apply a pushing bias force to said push rod relative to the fixed component of the loom.

15. An apparatus for controlling the thread tension of a pile warp for weaving a terry cloth web on a loom having a pile warp beam, a weaving reed and a weaving reed drive, said apparatus comprising a guide roller, a spanner beam adapted to apply a thread tension to the pile warp, at least two swing arms swingably supported at their respective upper ends on at least one common axis shaft and carrying said spanner beam to be swingable as a pendulum below said common axis shaft, a biasing force element operatively connected to at least one of said swing arms between said common axis shaft and said spanner beam and adapted to be supported against a fixed component of the loom to apply a biasing force to said spanner beam through said swing arm, and a controlled intermittently operative force relieving element operatively connected to at least one of said swing arms to intermittently overcome said biasing force.

* * * * *

UNITED STATES PATENT AND TRADEMARK OFFICE

CERTIFICATE OF CORRECTION

PATENT NO. : 5,458,160

DATED : Oct. 17, 1995

INVENTOR(S) : Erwin Geiger et al.

It is certified that error appears in the above-identified patent and that said Letters Patent is hereby corrected as shown below:

Column 2, line 3, delete "or stripped";
Column 4, line 41, after "arms" insert --6--;
Column 4, line 44, replace "shed 11" by --shed 42--;
Column 4, line 47, after "beam" insert --7--;
Column 4, line 48, after "rod" insert --11--;
Column 4, line 49, after "arm" insert --6--;
Column 4, line 50, after "rod" insert --14--;

Column 5, line 8, delete "10";
Column 5, line 17, delete ",";
Column 5, line 40, after "figure" insert --,--;
Column 6, line 51, after "drive" insert --,--;
Column 9, line 18, replace "1" by --11--.

Signed and Sealed this

Twentieth Day of February, 1996

*Attest:*

*Attesting Officer*

Bruce Lehman

BRUCE LEHMAN

*Commissioner of Patents and Trademarks*